US010605190B2

(12) United States Patent
Nishimura

(10) Patent No.: US 10,605,190 B2
(45) Date of Patent: Mar. 31, 2020

(54) INJECTION CONTROL UNIT

(71) Applicant: DENSO CORPORATION, Kariya, Aichi-pref (JP)

(72) Inventor: Toshio Nishimura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/676,180

(22) Filed: Aug. 14, 2017

(65) Prior Publication Data

US 2018/0156148 A1 Jun. 7, 2018

(30) Foreign Application Priority Data

Dec. 7, 2016 (JP) ..... 2016-237554

(51) Int. Cl.

| | |
|---|---|
| ***F02D 41/20*** | (2006.01) |
| ***F02D 41/04*** | (2006.01) |
| ***F02D 41/30*** | (2006.01) |
| *F02M 51/06* | (2006.01) |

(52) U.S. Cl.

CPC ..... *F02D 41/20* (2013.01); *F02D 41/04* (2013.01); *F02D 41/30* (2013.01); *F02D 2041/2006* (2013.01); *F02D 2041/2017* (2013.01); *F02D 2041/2024* (2013.01); *F02D 2041/2058* (2013.01); *F02M 51/061* (2013.01)

(58) Field of Classification Search

CPC ..... F02D 2041/2006; F02D 2041/2017; F02D 2041/2024; F02D 2041/2058; F02D 41/04; F02D 41/20; F02D 41/30; F02M 51/061

See application file for complete search history.

(56) References Cited

U.S. PATENT DOCUMENTS

| | | | | |
|---|---|---|---|---|
| 4,922,878 | A * | 5/1990 | Shinogle | F02D 41/20 123/490 |
| 10,087,870 | B2 * | 10/2018 | Imai | F02D 41/20 |
| 2002/0014223 | A1 * | 2/2002 | Marceca | F02D 41/20 123/490 |
| 2003/0010325 | A1 * | 1/2003 | Reischl | F02D 41/20 123/490 |
| 2009/0177369 | A1 | 7/2009 | Miyake et al. | |
| 2010/0242920 | A1 * | 9/2010 | Omori | F02D 41/20 123/490 |
| 2011/0106404 | A1 * | 5/2011 | Boee | F02D 41/20 701/103 |
| 2012/0180762 | A1 * | 7/2012 | Casasso | F02D 41/20 123/472 |
| 2012/0194961 | A1 * | 8/2012 | Yamada | F02D 41/20 361/152 |
| 2013/0139791 | A1 * | 6/2013 | Kusakabe | F02D 41/20 123/478 |

(Continued)

*Primary Examiner* — Carl C Staubach
(74) *Attorney, Agent, or Firm* — Posz Law Group, PLC

(57) ABSTRACT

An injection control unit includes a constant-current control unit executing a constant current control to control a current of a coil to be in a predetermined current range lower than a peak current by allowing or interrupting a first voltage applied to the coil after the peak current starting to open an injector is applied to the coil driving the injector, and a high-voltage applying control unit applying a second voltage higher than the first voltage to the coil in a case where a condition that the current of the coil becomes lower than the predetermined current range is met when the constant-current control unit executes the constant current control.

7 Claims, 6 Drawing Sheets

(56) References Cited

U.S. PATENT DOCUMENTS

| | | | | |
|---|---|---|---|---|
| 2014/0124601 | A1* | 5/2014 | Imai | F02D 41/20 239/585.1 |
| 2015/0300522 | A1* | 10/2015 | Ito | H01F 7/1844 361/170 |
| 2016/0047330 | A1 | 2/2016 | Mukaihara et al. | |
| 2016/0208725 | A1* | 7/2016 | Fukuda | F02D 41/20 |
| 2016/0363076 | A1* | 12/2016 | Kojima | F02D 41/20 |
| 2017/0051696 | A1 | 2/2017 | Mukaihara et al. | |
| 2017/0152803 | A1 | 6/2017 | Kusakabe et al. | |
| 2017/0335789 | A1* | 11/2017 | Kiuchi | F02D 41/20 |
| 2018/0017005 | A1* | 1/2018 | Kusakabe | F02D 41/20 |
| 2019/0170078 | A1* | 6/2019 | Nishimura | F02D 41/20 |
| 2019/0218987 | A1 | 7/2019 | Kusakabe et al. | |

* cited by examiner

INJECTION CONTROL UNIT

CROSS REFERENCE TO RELATED APPLICATION

This application is based on Japanese Patent Application No. 2016-237554 filed on Dec. 7, 2016, the disclosure of which is incorporated herein by reference.

TECHNICAL FIELD

The present disclosure relates to an injection control unit which controls to open or close an injector.

BACKGROUND

An injection control unit which controls to open or close an injector is a unit used to open or close the injector to inject a fuel. For example, when a voltage of a vehicle battery is a low voltage that is no more than 8V or no more than 6V, it is necessary to open or close the injector with reliability in a condition that is stricter than an ordinary condition.

SUMMARY

The inventor intends to improve the injection control unit to open or close the injector with reliability in a hard condition that the voltage of the vehicle battery that is a power voltage is the low voltage. According to JP2009-532625A, it is possible to apply a current that is high and is used to open the injector to a coil driving the injector again to open the injector with reliability based on a type of the injector, before a constant current control where a current lower than a peak current is applied to the coil after the peak current is applied to the coil is executed. However, it is possible that a current that is required cannot flow through the coil when the power voltage is applied to the coil in the hard condition that the power voltage is the low voltage.

It is an object of the present disclosure to provide an injection control unit which can control an injector with reliability in a case where an applied voltage that is a voltage applied to a coil driving the injector is a low voltage.

According to an aspect of the present disclosure, the injection control unit includes a constant-current control unit executing a constant current control to control a current of a coil to be in a predetermined current range lower than a peak current by allowing or interrupting a first voltage applied to the coil after the peak current starting to open an injector is applied to the coil driving the injector, and a high-voltage applying control unit applying a second voltage higher than the first voltage to the coil in a case where a condition that the current of the coil becomes lower than the predetermined current range is met when the constant-current control unit executes the constant current control. Thus, a high voltage can be applied to the coil, and the injection control unit can control to open or close the injector with reliability.

BRIEF DESCRIPTION OF THE DRAWINGS

The above and other objects, features and advantages of the present disclosure will become more apparent from the following detailed description made with reference to the accompanying drawings. In the drawings.

DESCRIPTION OF EMBODIMENTS

Figure 1:
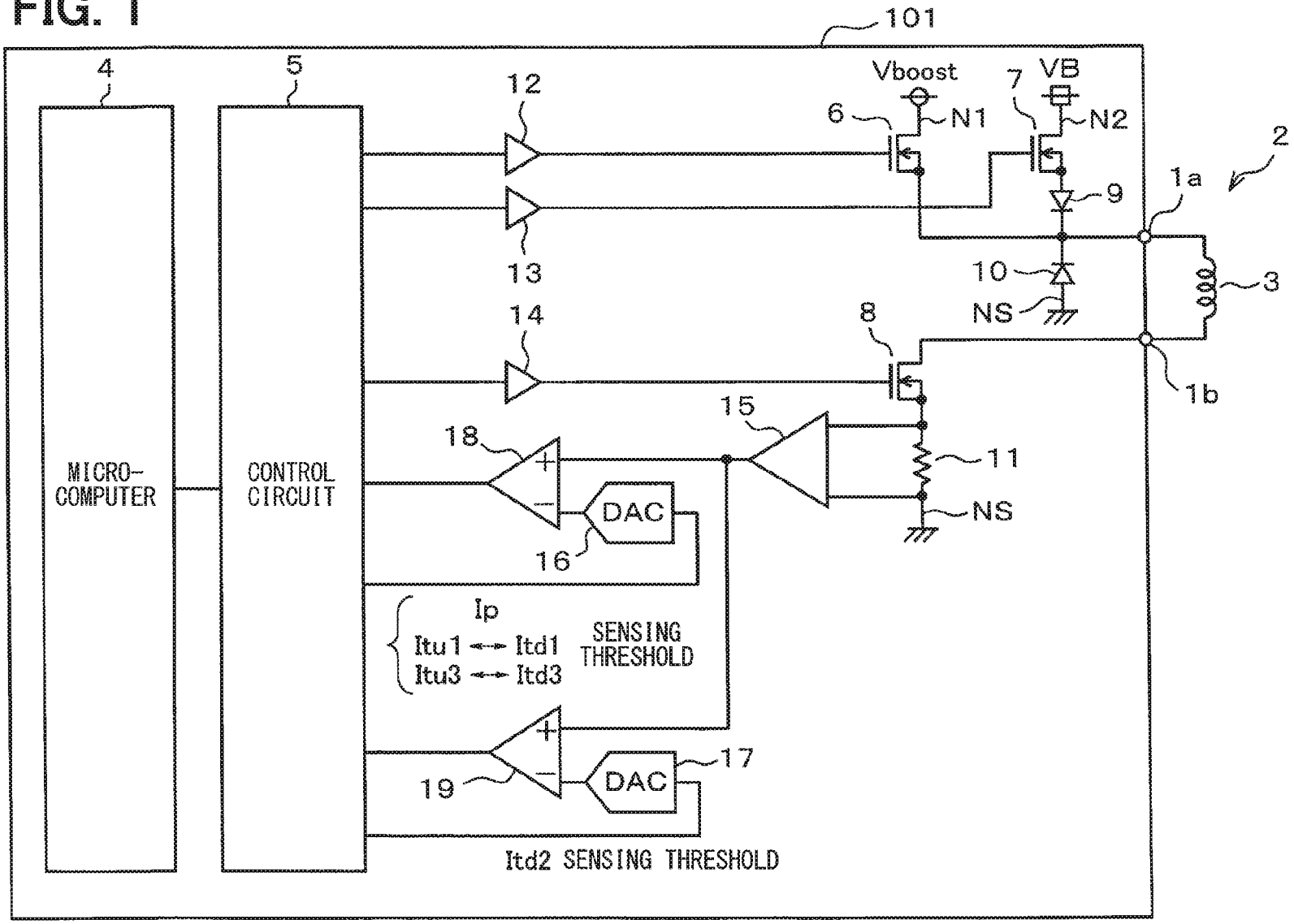
FIG. 1 is a block diagram showing an electric configuration of an injection control unit, according to a first embodiment of the present disclosure.

Referring to drawings, embodiments of the present disclosure will be described. The substantially same parts and the components as the following embodiments are indicated with the same reference numeral and the same description may be omitted.

(First Embodiment)

Figure 2:
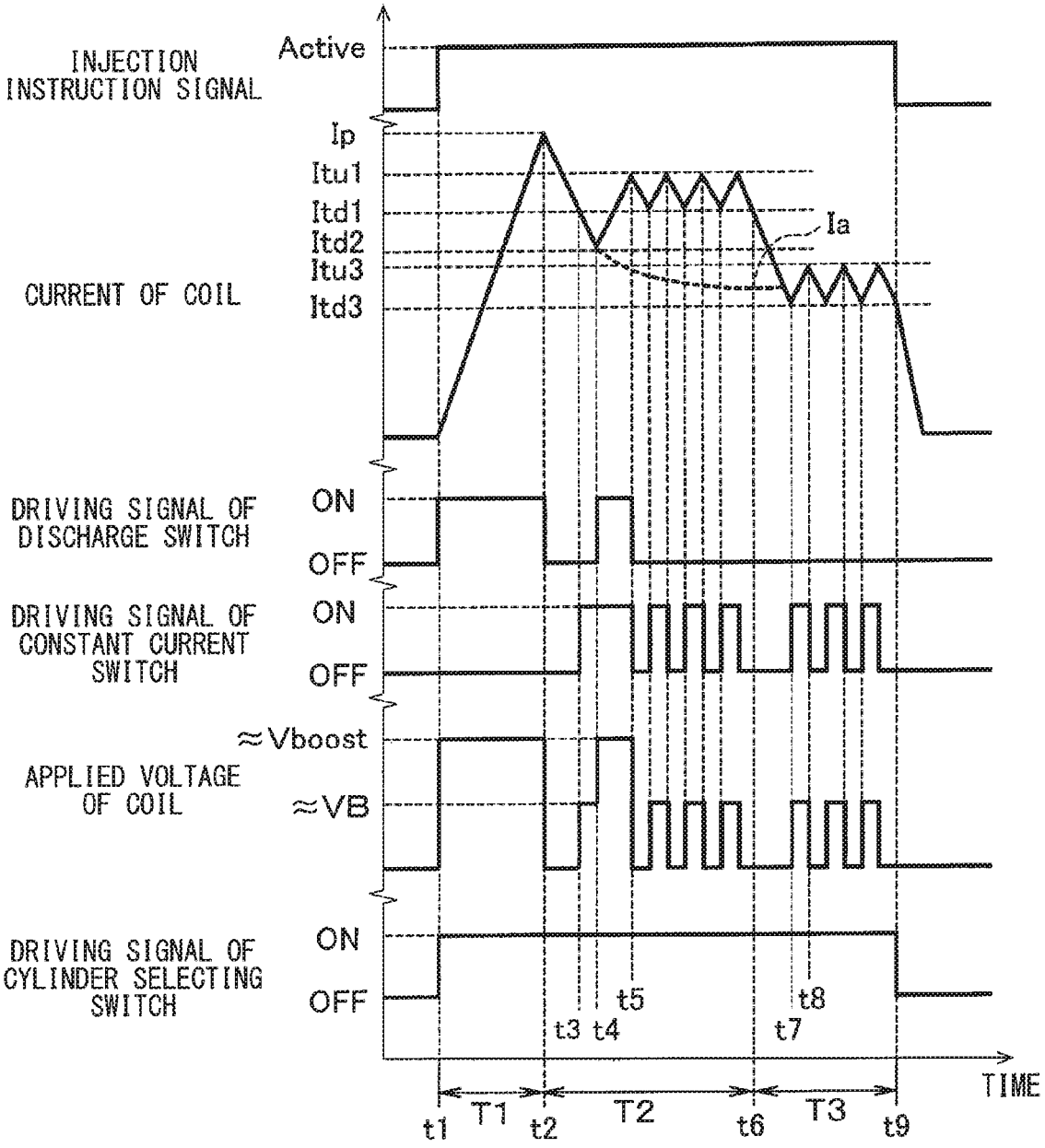
FIG. 2 is a time chart showing signal variations according to the first embodiment.

Referring to FIGS. 1 and 2, a first embodiment of the present disclosure will be described. FIG. 1 is a block diagram showing an electric configuration of an electronic control unit (ECU) 101 that is equivalent to an injection control unit. The electronic control unit 101 is a device driving injectors 2 of solenoid type which injects fuel to an engine that includes cylinders and is mounted to a vehicle such as an automobile. In this case, the engine includes N cylinders, and a total number of the injectors is also N. According to the present embodiment, N may be one or more. The electronic control unit 101 controls an energization start timing and an energization time interval of an electromagnetic coil 3 that is an inductive load constituting each of the injectors 2. According to the present embodiment, the electromagnetic coil 3 is referred to as a coil 3. Each of the injectors 2 is an electromagnetic valve of a normally closed type. When a current flows through the coil 3, the injector 2 is opened. The fuel that is compressed by a fuel pump is supplied to the injector 2. When the injector 2 is opened, the fuel that is compressed is supplied to an internal combustion engine that is the above engine. Since the injector 2 injects the fuel to the internal combustion engine, a mixture air is generated.

As shown in FIG. 1, the electronic control unit 101 includes main components that include a microcomputer 4, a control circuit 5, a discharge switch 6, a constant current switch 7 that is a switch of a constant current control, and a cylinder selecting switch 8 that is a switch of a cylinder selecting. The electronic control unit 101 starts or terminates an energization of the coil 3 driving the injector 2 to open or close. The electronic control unit 101 further includes peripheral circuits that are associated with the main components and include a backflow preventing diode 9, a circulation diode 10, a current sensing resistance 11, voltage buffers 12, 13 and 14 that are a first voltage buffer 12, a second voltage buffer 13 and a third voltage buffer 14, an amplifier 15 that senses a voltage generated at the current sensing resistance 11, D-A converters 16 and 17 that are a first D-A converter 16 and a second D-A converter 17, and comparators 18 and 19 that are a first comparator 18 and a second comparator 19.

The microcomputer 4 includes a CPU, an EEPROM, and an SRAM that are not shown. The microcomputer 4 operates based on a program stored in a memory that is equivalent to a non-transitive substantive storage media. The microcomputer 4 outputs an injection instruction signal to the control circuit 5 at an injection instruction timing. The control circuit 5, the amplifier 15, the D-A converters 16 and 17, and the comparators 18 and 19 are constituted by integrated circuit units such as application specific integrated circuits (ASICs). The control circuit 5 includes a control subject including a logic circuit and a CPU, and a storage unit including a RAM, a ROM and an EEPROM. The control circuit 5 executes various controls based on hardware and software.

The control circuit 5 controls to turn on or turn off the discharge switch 6, the constant current switch 7 and the cylinder selecting switch 8 by the voltage buffers 12 to 14, senses a current flowing through the current sensing resistance 11 by a terminal voltage of the current sensing resistance 11, and executes the various controls according to a sensing signal indicating the current. According to the present embodiment, the control circuit 5 achieves functions of a high-voltage applying control unit and a constant-current control unit. The discharge switch 6, the constant current switch 7 and the cylinder selecting switch 8 are constituted by MOS transistors of N-channel type, respectively. According to the present disclosure, the switches 6 to 8 may be constituted by other transistors such as bipolar transistors.

The MOS transistor constituting the discharge switch 6 includes a gate that is connected with the control circuit 5 through the first voltage buffer 12, a drain that is connected with a first supplying node N1 that is a supplying node of a boost voltage Vboost, and a source that is connected with an upstream terminal 1*a* that is a terminal located upstream of the electronic control unit 101. A drain and a source of the MOS transistor constituting the constant current switch 7 are connected with a second supplying node N2 that is a supplying node of a power voltage VB and the upstream terminal 1*a*, respectively. In other words, the drain and the source of the MOS transistor constituting the constant current switch 7 are arranged between the second supply node N2 and the upstream terminal 1*a*. The backflow preventing diode 9 is connected with the source of the constant current switch 7 and the upstream terminal 1*a*. In other words, the backflow preventing diode 9 is arranged between the constant current switch 7 and the upstream terminal 1*a*. A gate of the MOS transistor constituting the constant current switch 7 is connected with the control circuit 5 through the second voltage buffer 13. The circulation diode 10 is connected with the upstream terminal 1*a* and a ground node NS in a reversing direction. In other words, the circulation diode 10 is arranged between the upstream terminal 1*a* and the ground node NS in the reversing direction.

The coil 3 of the injector 2 that is a driving object is connected with the upstream terminal 1*a* and a downstream terminal 1*b* that is a terminal downstream of the electronic control unit 101. In other words, the coil 3 is arranged between the upstream terminal 1*a* and the downstream terminal 1*b*. A drain of the MOS transistor constituting the cylinder selecting switch 8 is connected with the downstream terminal 1*b*, a source of the MOS transistor constituting the cylinder selecting switch 8 is connected with a first terminal of the current sensing resistance 11, and a second terminal of the current sensing resistance 11 is connected with a ground node NS. In other words, the drain and the source of the MOS transistor constituting the cylinder selecting switch 8 and the current sensing resistance 11 are arranged between the downstream terminal 1*b* and the ground node NS in a series connection. A gate of the MOS transistor constituting the cylinder selecting switch 8 is connected with the control circuit 5 through the third voltage buffer 14.

The terminal voltage of the current sensing resistance 11 that is a voltage between the first terminal and the second terminal of the current sensing resistance 11 is inputted to the amplifier 15. The amplifier 15 amplifies the terminal voltage that is sensed at the current sensing resistance 11, and outputs the terminal voltage that is amplified to non-inverting input terminals of the comparators 18 and 19. The control circuit 5 time-serially switches and outputs a voltage corresponding to a current sensing threshold to an inverting input terminal of the first comparator 18 through the first D-A converter 16. In this case, the current sensing threshold that is a sensing threshold includes a peak current threshold Ip, a first upper limit Itu1 and a first lower limit Itd1 of a first predetermined current range, and a second upper limit Itu3 and a third lower limit Itd3 of a second predetermined current range. According to the present embodiment, the peak current threshold Ip is equivalent to a peak current.

The control circuit 5 outputs the voltage corresponding to the current sensing threshold to an inverting input terminal of the second comparator 19 through the second D-A converter 17. In this case, the current sensing threshold that is the sensing threshold is equivalent to a predetermined current value Itd2 that is lower than the first lower limit Itd1 of the first predetermined current range. Thus, the control circuit 5 can determine whether the current flowing through the current sensing resistance 11 reaches the current sensing threshold.

FIG. 2 is a time chart showing one valve-opening interval of the injector 2.

When a power switch such as an ignition switch that is not shown is turned on, the power voltage VB that is equivalent to a first voltage is supplied to the microcomputer 4 and the control circuit 5 of the electronic control unit 101. Then, a boost circuit that is not shown generates the boost voltage Vboost by boosting the power voltage VB and outputs the boost voltage Vboost to the first supplying node N1. In this case, the boost voltage Vboost that is equivalent to a second voltage is a voltage higher than the power voltage VB. The control circuit 5 digitally instructs the first D-A converter 16 to output the voltage corresponding to the peak current threshold Ip to the inverting input terminal of the first comparator 18. Normally, the first comparator 18 outputs a signal indicating an L level. When the current flowing through the current sensing resistance 11 reaches the peak current threshold Ip, the first comparator 18 outputs a signal indicating an H level.

When the fuel is injected in a cylinder, the microcomputer 4 outputs an active level of the injection instruction signal to the control circuit 5. In this case, the active level of the injection instruction is the H level. The control circuit 5 controls to turn on the cylinder selecting switch 8 at a timing t1 shown in FIG. 2. As shown in FIG. 2, the timing t1 is an on timing of a driving signal of the cylinder selecting switch 8. The control circuit 5 controls to turn on the discharge switch 6 at or right after the timing t1. As shown in FIG. 2, the timing t1 is equivalent to an on timing of a driving signal of the discharge switch 6.

When the cylinder selecting switch 8 and the discharge switch 6 are turned on, the boost voltage Vboost is applied to the coil 3. As shown in FIG. 2, a current of the coil 3 can be increased, and the injector 2 can start to open in a peak current control interval T1 from the timing t1 to a timing t2. According to the present embodiment, the current of the coil 3 that is the current flowing through the coil 3 is equivalent to the current flowing through the current sensing resistance 11. Since the terminal voltage of the current sensing resistance 11 is sensed, the current flowing through the coil 3 that is equivalent to the current flowing through the current sensing resistance 11 can be sensed by using the current sensing resistance 11.

When the current of the coil 3 reaches the peak current threshold Ip at the timing t2 shown in FIG. 2, the first comparator 18 outputs the signal indicating the H level changed from the L level to the control circuit 5. The control circuit 5 switches to execute a pick-up current control during a pick-up current control interval T2 shown in FIG. 2 when receiving an output change of the first comparator 18.

When an energy supplied to the coil 3 reaches a valve-opening required value that is predetermined, the injector 2 completely opens. In other words, when the energy supplied to the coil 3 reaches the valve-opening required value, the injector 2 becomes in a fully opening state. The valve-opening required value that is equivalent to an energy required to completely open the injector 2 is established based on a value by integrating an energization current quantity of the coil 3 of the injector 2 relative to time. In other words, as shown in FIG. 2, the valve-opening required value is established based on a time integrated value of the current of the coil 3.

When the peak current control interval T1 becomes shorter according to a type of the injector 2, the energy supplied to the coil 3 in a control during the peak current control interval T1 does not reach the valve-opening required value. In this case, it is possible that the injector 2 cannot be reliably opened.

The pick-up current control is provided to correct the energy required to completely open the injector 2. Since the control circuit 5 can increase an energization current of the coil 3 to be in the first predetermined current range from the first upper limit Itu1 to the first lower limit Itd1 which is close to the peak current threshold Ip by executing the pick-up current control to control the current of the coil 3, the control circuit 5 can reliably open the injector 2. According to the present embodiment, the energization current of the coil 3 is equivalent to the current of the coil 3.

When the control circuit 5 senses that the current of the coil 3 reaches the peak current threshold Ip at the timing t2 shown in FIG. 2, the control circuit 5 controls to turn off the discharge switch 6. The control circuit 5 digitally instructs the first D-A converter 16 to output the voltage corresponding to the first lower limit Itd1 of the first predetermined current range to the inverting input terminal of the first comparator 18. Thus, the first comparator 18 can determine whether the current flowing through the current sensing resistance 11 reaches the first lower limit Itd1 of the first predetermined current range.

When the control circuit 5 controls to turn off the discharge switch 6 at the timing t2 shown in FIG. 2, an inductive voltage is generated between two ends of the coil 3 of the injector 2. In this case, a current generated based on the inductive voltage flows through the coil 3 through the circulation diode 10. As shown in FIG. 2, the energization current of the coil 3 continuously decreases from the timing t2 to a timing t4 through a timing t3. When the first comparator 18 determines that the current of the coil 3 reaches the first lower limit Itd1 of the first predetermined current range at the timing t3 shown in FIG. 2, the first comparator 18 outputs the signal indicating the L level changed from the H level to the control circuit 5.

When the control circuit 5 receives the output change of the first comparator 18, the control circuit 5 controls to turn on the constant current switch 7. As shown in FIG. 2, the timing t3 is equivalent to an on timing of the driving signal of the constant current switch 7. When the energization current of the coil 3 reaches the first lower limit Itd1 of the first predetermined current range at the timing t3 in a case where the power voltage VB is a low voltage that is no more than 8V or no more than 6V, it is possible that a current that is required cannot flow through the coil 3 where the control circuit 5 applies the power voltage VB to the coil 3 to increase the current of the coil 3 again. In this case, the current of the coil 3 continuously decreases. According to the present embodiment, the power voltage VB is equivalent to an applied voltage of the coil 3 that is a voltage applied to the coil 3. When no control is executed, the current of the coil 3 decreases in accordance with a time constant that is predetermined as a current Ia shown in FIG. 2.

When the current of the coil 3 reaches a second lower limit Itd2 that is the predetermined current value Itd2 lower than the first lower limit Itd1 at the timing t4 shown in FIG. 2, the second comparator 19 senses that the current of the coil 3 reaches the second lower limit Itd2 at the timing t4 shown in FIG. 2 and outputs the signal indicating the L level changed from the H level to the control circuit 5. When the control circuit 5 receives an output change of the second comparator 19, the control circuit 5 controls to turn on the discharge switch 6. As shown in FIG. 2, the timing t4 is equivalent to an on timing of the driving signal of the discharge switch 6.

The control circuit 5 digitally instructs the first D-A converter 16 to output the voltage corresponding to the first upper limit Itu1 of the first predetermined current range to the inverting input terminal of the first comparator 18. Thus, the first comparator 18 can determine whether the current flowing through the current sensing resistance 11 reaches the first upper limit Itu1 of the first predetermined current range. Since the boost voltage Vboost is higher than the power voltage VB, the current of the coil 3 is readily increased when the boost voltage Vboost is applied to the coil 3. When the energization current of the coil 3 is increased, the energization current can be increased to a value that is equal to the first upper limit Itu1 of the first predetermined current range.

When the current of the coil 3 reaches the first upper limit Itu1 of the first predetermined current range, the first comparator 18 senses that the current of the coil 3 reaches the first upper limit Itu1 of the first predetermined current range at a timing t5 shown in FIG. 2 and outputs the signal indicating the H level changed from the L level to the control circuit 5. When the control circuit 5 receives the output change of the first comparator 18, the control circuit 5 controls to turn off the discharge switch 6 and the constant current switch 7. As shown in FIG. 2, the timing t5 is equivalent to an off timing of the driving signal of the discharge switch 6 and an off timing of a driving signal of the constant current switch 7.

The control circuit 5 digitally instructs the first D-A converter 16 to output the voltage corresponding to the first lower limit Itd1 of the first predetermined current range to the inverting input terminal of the first comparator 18. When the discharge switch 6 and the constant current switch 7 are turned off, the current of the coil 3 decreases. When the current of the coil 3 reaches the first lower limit Itd1 of the first predetermined current range, the control circuit 5 controls to turn on the constant current switch 7 again. In a time interval from the timing t5 to a timing t6 as shown in FIG. 2, the control circuit 5 controls to turn on or turn off the constant current switch 7 to control the current of the coil 3 sensed by the current sensing resistance 11 to be in the first predetermined current range.

When the pick-up current control interval T2 from the timing t2 to the timing t6 shown in FIG. 2 has elapsed, the control circuit 5 terminates the pick-up current control and switches to execute a holding control from the timing t6 to a timing t9 shown in FIG. 2. According to the present embodiment, the holding control is equivalent to the constant current control. The holding control is a control executed to maintain a state of the injector 2 that is opened in the pick-up current control.

The control circuit 5 controls to turn on or turn off the constant current switch 7 to maintain the energization current of the coil 3 to he in the second predetermined current range from the second upper limit Itu3 to the third lower limit Itd3. The second upper limit Itu3 of the second predetermined current range is set to be lower than the first upper limit Itu1 of the first predetermined current range, and the third lower limit Itd3 of the second predetermined current range is set to be lower than the first lower limit Itd1 of the first predetermined current range. According to the present embodiment, the first lower limit Itd1 of the first predetermined current range is set to be higher than the second upper limit Itu3 of the second predetermined current range. However, according to the present disclosure, the first lower limit Itd1 of the first predetermined current range may be set to be equal to or lower than the second upper limit Itu3 of the second predetermined current range.

When the control circuit 5 starts the holding control, the control circuit 5 digitally instructs the first D-A converter 16 to output a voltage corresponding to the third lower limit Itd3 of the second predetermined current range to the inverting input terminal of the first comparator 18. When the control circuit 5 starts the holding control, the current of the coil 3 decreases. When the current of the coil 3 reaches the third lower limit Itd3 of the second predetermined current range, the first comparator 18 senses that the current of the coil 3 reaches the third lower limit Itd3 and outputs the signal indicating the L level changed from the H level to the control circuit 5. When the control circuit 5 receives the output change of the first comparator 18, the control circuit 5 controls to turn on the constant current switch 7. The control circuit 5 digitally instructs the first D-A converter 16 to output a voltage corresponding to the second upper limit Itu3 of the second predetermined current range to the inverting input terminal of the first comparator 18. When the constant current switch 7 is turned on, the energization current of the coil 3 increases. When the current of the coil 3 reaches the second upper limit Itu3 at a timing t8 shown in FIG. 2, the control circuit 5 controls to turn off the constant current switch 7 again. The control circuit 5 digitally instructs the first D-A converter 16 to output a voltage corresponding to the third lower limit Itd3 of the second predetermined current range to the inverting input terminal of the first comparator 18. When the constant current switch 7 is turned off, the energization current of the coil 3 decreases. Since the control circuit 5 repeatedly executes the above processings, the current of the coil 3 can be maintained to be in the second predetermined current range.

When the microcomputer 4 senses that an injection time has elapsed and outputs the active level of the injection instruction signal that is the L level to the control circuit 5, the control circuit 5 controls to turn off the cylinder selecting switch 8. In this case, the control circuit 5 controls to turn off the constant current switch 7. Thus, the control circuit 5 can close the injector 2 and can terminate the injection control relative to the cylinder.

According to the present embodiment, when the constant current control is executed to control the current of the coil 3 to be in the first predetermined current range that is lower than the peak current threshold Ip by allowing or interrupting the power voltage VB applied to the coil 3 after the boost voltage Vboost is supplied to the coil 3 to make the current of the coil 3 reach the peak current threshold Ip, the control circuit 5 applies the boost voltage Vboost to the coil 3 in a case where a condition that the current of the coil 3 reaches the second lower limit Itd2 that is lower than the first lower limit Itd1 of the first predetermined current range is met, Thus, since the constant current control can be executed to control the current of the coil 3 to be in the first predetermined current range by applying the boost voltage Vboost to the coil 3 when the power voltage VB is the low voltage that is no more than 6V or no more than 8V, the injector 2 can be reliably completely opened. According to the present embodiment, the boost voltage Vboost is equivalent to the applied voltage of the coil 3.

According to the present embodiment, in one valve-opening interval of the injector 2 from the timing t1 to the timing t9, the control circuit 5 executes the constant current control equivalent to a first constant current control to control the current of the coil 3 to be in the first predetermined current range from the first upper limit Itu1 to the first lower limit Itd1 and then executes the constant current control equivalent to a second constant current control to control the current of the coil 3 to be in the second predetermined current range from the second upper limit Itu3 to the third lower limit Itd3 that is lower than the first predetermined current range. In this case, when the second predetermined current range is lower than the first predetermined current range, the second upper limit Itu3 of the second predetermined current range is lower than the first lower limit Itd1 of the first predetermined current range. Alternatively, according to the present disclosure, when the second predetermined current range is lower than the first predetermined current range, the second upper limit Itu3 of the second predetermined current range may be lower than the first upper limit Itu1 of the first predetermined current range. The control circuit 5 applies the boost voltage Vboost to the coil 3 in a case where a condition that the current of the coil 3 reaches the second lower limit Itd2 that is lower than the first lower limit Itd1 of the first predetermined current range is met. Thus, the injector 2 can be reliably completely opened.

As shown in FIG. 2, when the current of the coil 3 initially reaches the second lower limit Itd2 that is lower than the first lower limit Itd1 of the first predetermined current range after the current of the coil 3 decreases from the peak current threshold Ip, the control circuit 5 applies the boost voltage Vboost to the coil 3 for one time. However, according to the present disclosure, the control circuit 5 may apply the boost voltage Vboost to the coil 3 for two or more times in a case where a condition that the current of the coil 3 reaches the second lower limit Itd2 is met in the pick-up current control interval T2 where the pick-up current control is continuously executed. In this case, the pick-up current control interval T2 is equivalent to a predetermined time interval from the timing t2 to the timing t6 shown in FIG. 2. An upper limit of a total number of applying the boost voltage Vboost to the coil 3 may be set to a predetermined number that is previously established. Thus, the pick-up current control can be executed to control the current of the coil 3 to be in the first predetermined current range.

Since the control circuit 5 applies the boost voltage Vboost to the coil 3 only when the current of the coil 3 is not increased, an electric charge accumulated in a capacitor that is not shown and maintains the boost voltage Vboost can be saved. In other words, a capacity value of the capacitor may be reduced, and it is unnecessary to increase a boost capability of the boost circuit generating the boost voltage Vboost.

(Second Embodiment)

Figure 3:
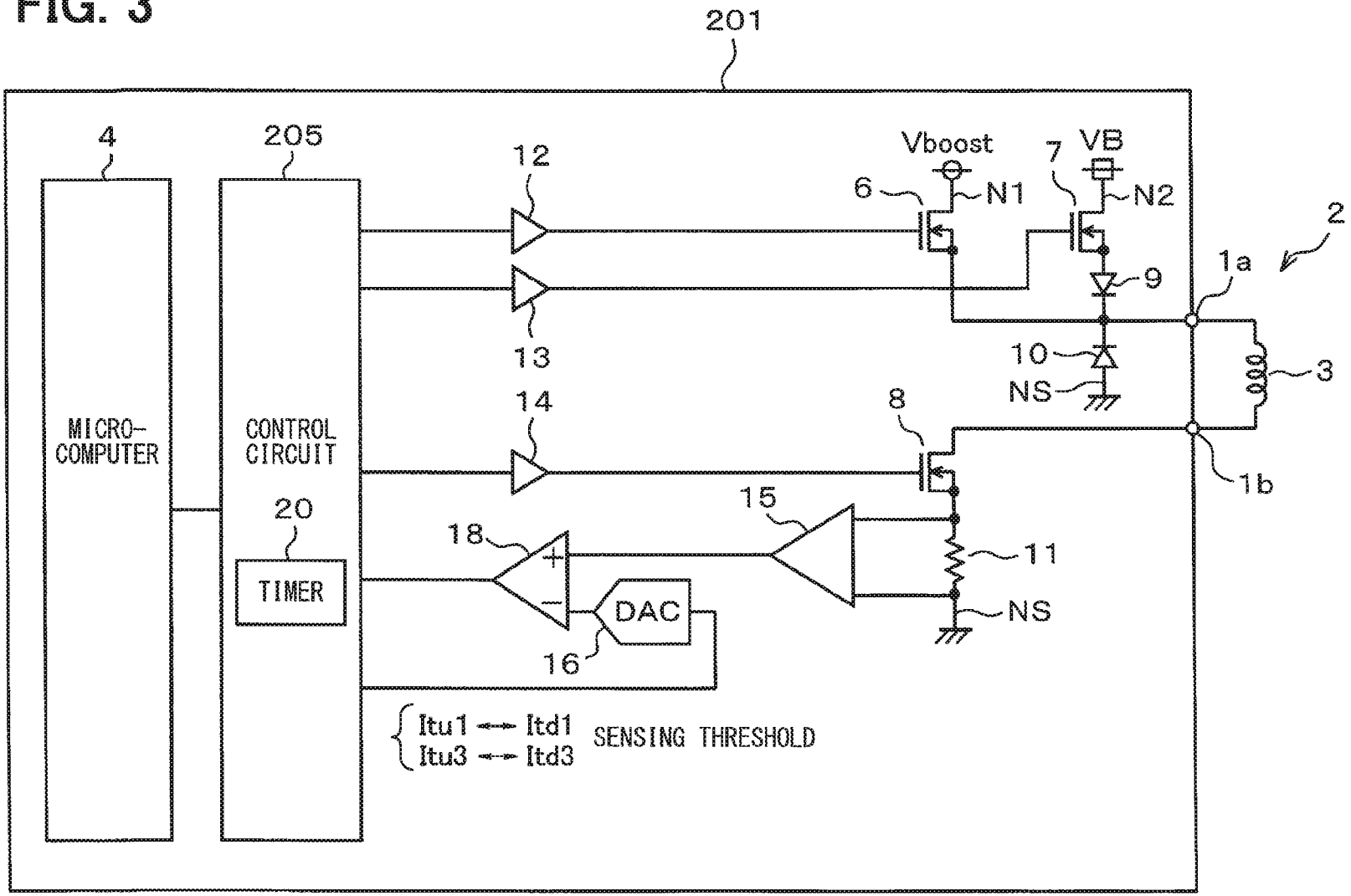
FIG. 3 is a block diagram showing the electric configuration of the injection control unit, according to a second embodiment of the present disclosure.
Figure 4:
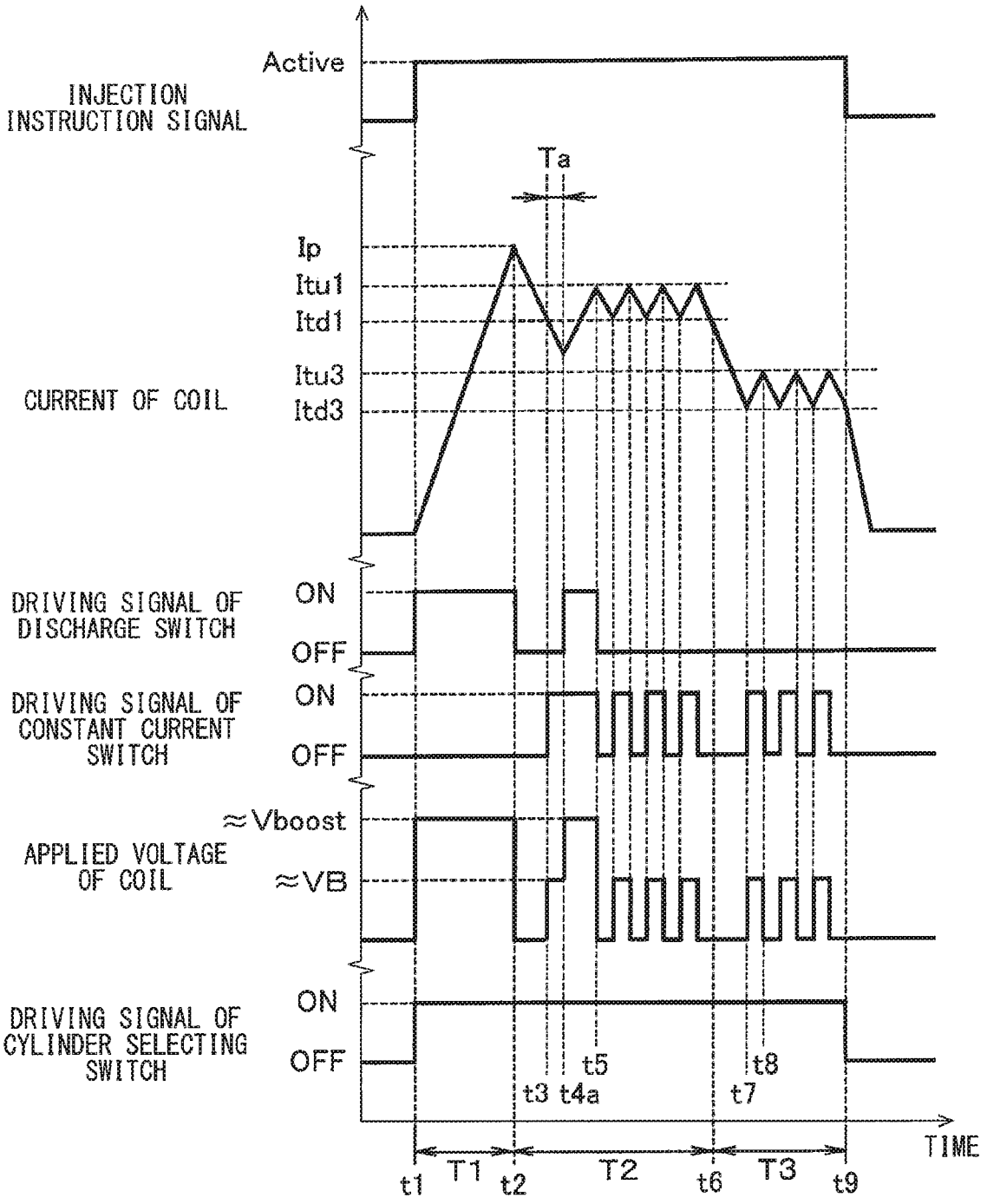
FIG. 4 is a time chart showing signal variations according to the second embodiment.

FIGS. 3 and 4 indicate a second embodiment of the present disclosure. As shown in FIG. 3, in an electric configuration of an electronic control unit 201, the second comparator 19 and the second D-A converter 17 of the electronic control unit 101 are not provided. Further, the electronic control unit 201 includes a control circuit 205 that includes a timer 20 and is provided to replace the control circuit 5 in the electronic control unit 101. The timer 20 is a timer that measures an elapsed timing that a predetermined time interval Ta has elapsed from a timing that the current of the coil 3 becomes lower than the first lower limit Itd1 of the first predetermined current range. The predetermined time interval Ta is a first predetermined time interval that is set by assuming a hard condition that the power voltage VB is a lowest voltage that is no more than 6V. Specifically, the predetermined time interval Ta is set to a time interval longer than an upper limit of a time interval from a timing that the current of the coil 3 reaches the first lower limit Itd1 to a timing that the current of the coil 3 reaches the first upper limit Itu1 in the hard condition. In other words, the predetermined time interval Ta is set to a time interval longer than an upper limit of a time interval where the current of the coil 3 varies from the first lower limit Itd1 to the first upper limit Itu1. Other parts of components of the electric configuration of the electronic control unit 201 are substantially same as those in the first embodiment, and the same descriptions will be omitted.

FIG. 4 is a time chart showing one valve-opening interval of the injector 2. The descriptions relating to the peak current control interval T1 until the current of the coil 3 reaches the peak current threshold Ip are the same as those in the first embodiment and will be omitted. When the control circuit 205 senses that the current of the coil 3 reaches the peak current threshold Ip at the timing t2 shown in FIG. 4, the control circuit 205 controls to turn off the discharge switch 6. Thus, the current of the coil 3 decreases. When the current of the coil 3 becomes lower than the first lower limit Itd1 of the first predetermined current range at the timing t3, the comparator 18 that is the first comparator 18 in the first embodiment outputs the signal indicating the L level changed from the H level. When the control circuit 205 receives the output change of the comparator 18, the control circuit 205 controls to turn on the constant current switch 7. When the power voltage VB is the low voltage, it is possible that a current that is required cannot flow through the coil 3 where the control circuit 205 applies the power voltage VB to the coil 3.

Thus, the timer 20 of the control circuit 205 measures the elapsed timing that the predetermined time interval Ta has elapsed from the timing that the current of the coil 3 becomes lower than the first lower limit Itd1, and the control circuit 205 controls to turn on the discharge switch 6 to apply the boost voltage Vboost to the coil 3 at the elapsed timing that is a timing t4*a* shown in FIG. 4. Thus, the current of the coil 3 can be increased. Thus, the current of the coil 3 can be controlled to reach the first predetermined current range. The descriptions relating to a time interval from the timing t4*a* to the timing t9 are the same as those in the first embodiment and will be omitted.

According to the present embodiment, when the predetermined time interval has elapsed from a timing that the current of the coil 3 becomes lower than the first predetermined current range, the control circuit 205 applies the boost voltage Vboost to the coil 3. In this case, when the current of the coil 3 becomes lower than the first predetermined current range, the current of the coil 3 becomes lower than the first lower limit Itd1 of the first predetermined current range. Thus, effects that are the same as those in the first embodiment will be achieved.

(Third Embodiment)

Figure 5:
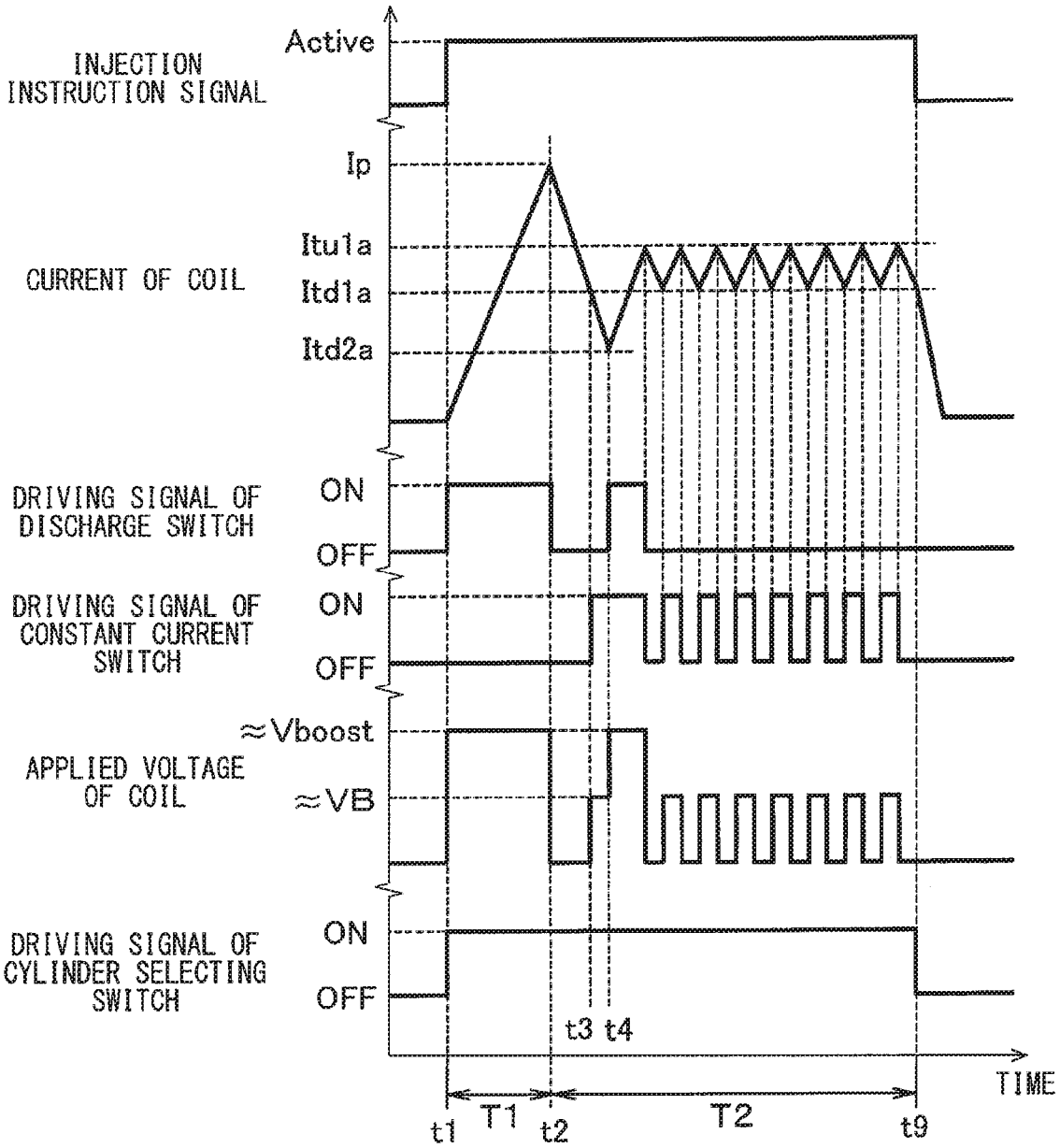
FIG. 5 is a time chart showing signal variations according to a third embodiment of the present disclosure.

FIG. 5 indicates a third embodiment of the present disclosure. According to the present embodiment, when the current of the coil 3 reaches the peak current threshold Ip, the constant current control in a predetermined region is only executed for one time in a time interval from the timing t2 to the timing t9. In other words, comparing with the first embodiment, the second constant current control is not executed in the present embodiment. The substantially same parts and components as the first embodiment are indicated with the same reference numeral.

As shown in FIG. 5, timings t1 to t4 and t9 are indicated same as those in the first embodiment, a constant current control range includes a first upper limit that is indicated by Itu1*a* and a first lower limit that is indicated by Itd1*a*, and a second lower limit is indicated by Itd2*a*. When a condition that the current of the coil 3 reaches the second lower limit Itd2*a* that is lower than the first lower limit Itd1*a* of the constant current control range is met, the control circuit 5 applies the boost voltage Vboost to the coil 3. According to the present embodiment, effects that are the same as those in the first embodiment will be achieved.

According to the present embodiment, at least a part of the pick-up current control interval T2 from the timing t2 to the timing 19 shown in FIG. 5 is referred to as a second predetermined time interval. In this case, the control circuit 5 may apply the boost voltage Vboost to the coil 3 in a limit that is the second predetermined time interval. Alternatively, the control circuit 5 may apply the boost voltage Vboost to the coil 3 in the second predetermined time interval for at least one time in a limit that is an upper limit number that is predetermined. In this case, the upper limit number is the upper limit of the total number of applying the boost voltage Vboost to the coil 3.

(Fourth Embodiment)

Figure 6:
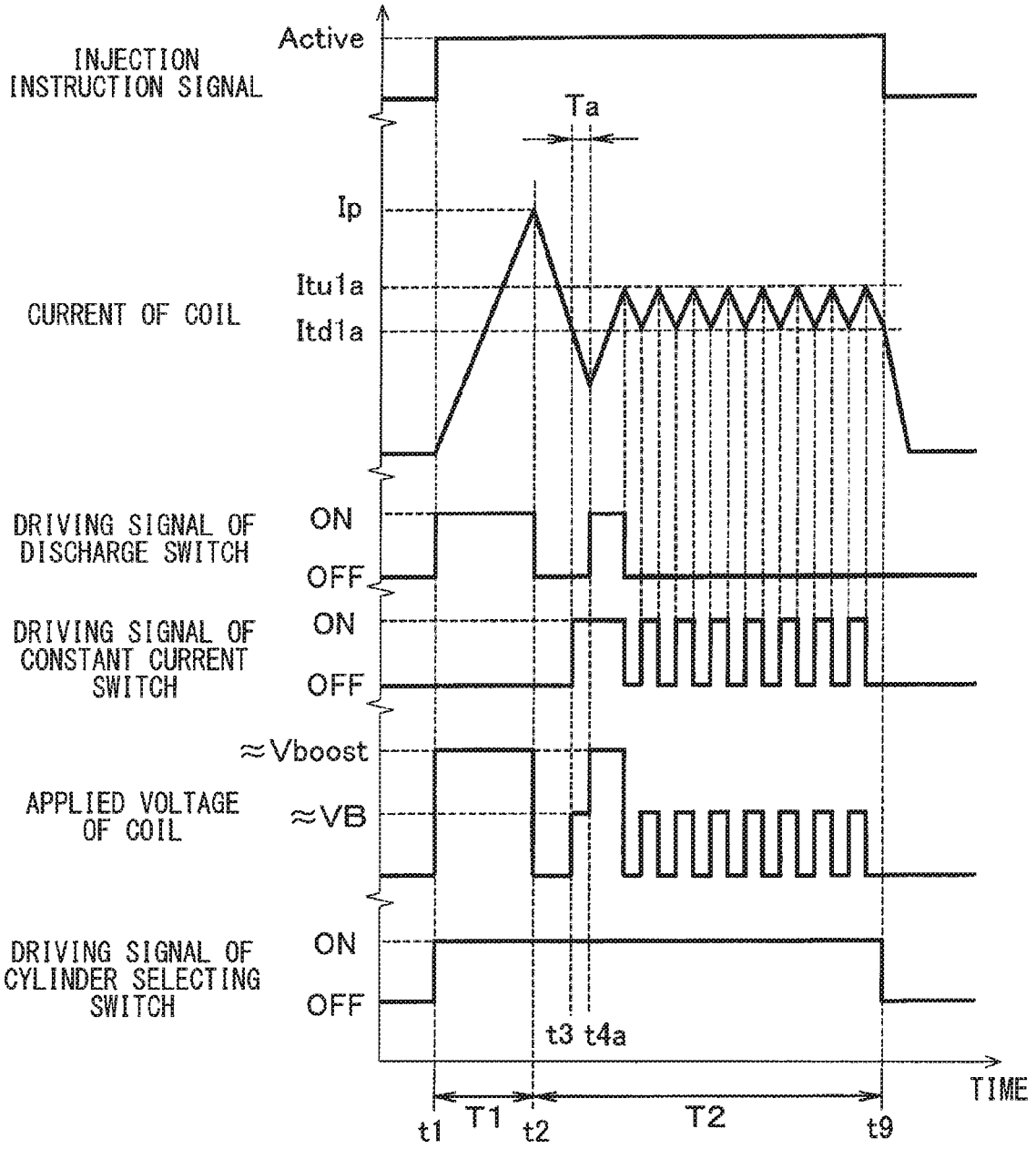
FIG. 6 is a time chart showing signal variations according to a fourth embodiment of the present disclosure.

FIG. 6 indicates a fourth embodiment of the present disclosure. According to the present embodiment, when the current of the coil 3 reaches the peak current threshold Ip, the constant current control is only executed for one time in a time interval from the timing t2 to the timing t9. Further, the present embodiment is equivalent to the second embodiment except that the second constant current control is not executed. The substantially same parts and components as the second embodiment are indicated with the same reference numeral.

As shown in FIG. 6, timings t1 to t3, t4*a* and t9 are indicated same as those in the first embodiment, and a constant current control range includes a first upper limit that is indicated by Itu1*a* and a first lower limit that is indicated by Itd1*a*. When the predetermined time interval Ta has elapsed from a timing that the current of the coil 3 becomes lower than the first lower limit Itd1*a* of the constant current range, the control circuit 205 applies the boost voltage Vboost to the coil 3. According to the present embodiment, effects that are the same as those in the second embodiment will be achieved.

(Other Embodiment)

The present disclosure is not limited to the embodiments mentioned above, and can be applied to various embodiments within the spirit and scope of the present disclosure. The present disclosure may be modified or extended as followings.

According to the first embodiment and the third embodiment, the boost voltage Vboost is applied to the coil 3 in a case where a condition that the current of the coil 3 reaches the second lower limit Itd2 or Itd2*a* is met. According to the second embodiment and the fourth embodiment, the boost voltage Vboost is applied to the coil 3 in a case where a condition that the predetermined time interval Ta has elapsed from a timing that the current of the coil 3 becomes lower than the first lower limit Itd1 or Itd1*a* is met, However, according to the present disclosure, the boost voltage Vboost higher than the power voltage VB may be applied to the coil 3 in a case where a condition that the current of the coil 3 is lower than a predetermined current range is sensed by using other manners.

According to the first embodiment, the control circuit 5, the amplifier 15, the D-A converters 16 and 17, and the comparators 18 and 19 are constituted by integrated circuit units such as application specific integrated circuits (ASICs). However, according to the present disclosure, the above components may be constituted by integrated circuit units that include other circuits or blocks. Similarly, the components in the second embodiment, the third embodiment and the fourth embodiment may be constituted by integrated circuit units that include other circuits or blocks.

According to the present disclosure, the control circuits 5 and 205 may be replaced by other control units. The control units have functions which can be achieved by a computer that executes software stored in a memory that is substantial and the software, software, hardware, or a combination of the above. For example, when the control units are constituted by circuits that are hardware, the circuits may include a digital circuit including at least one logic circuit or may include an analog circuit. When the control units execute various controls by software, storage units of the control units store programs, and control subjects of the control units execute the programs to execute corresponding controls.

According to the above embodiments, the coil 3 that drives the injector 2 of one cylinder is described so as to simplify descriptions. However, the present disclosure can be applied to configurations that have cylinders such as two cylinders, four cylinders and six cylinders.

According to the above embodiments, the discharge switch 6, the constant current switch 7, the cylinder selecting switch 8 are constituted by MOS transistors. However, the above switches may be other transistors such as bipolar transistors, or may be various switches.

The present disclosure may be applied to a combination of the above embodiments. A part of the above configuration according to the above embodiments may be canceled in a case where the above matters are stilled solved. The present disclosure is not limited to the embodiments mentioned above, and can be applied to various embodiments within the spirit and scope of the present disclosure.

While the present disclosure has been described with reference to the embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An injection control unit comprising:

a constant-current control unit executing a constant current control, which controls a current in a coil, which drives an injector, to be in a predetermined current range lower than a peak current in the coil, by repeatedly allowing or interrupting a first voltage applied to the coil after the peak current causes the injector to start to open;

a determining unit configured to determine whether the current in the coil reaches a second lower limit lower than a first lower limit of the predetermined current range after the first voltage is applied to the coil by the constant-current control unit; and a high-voltage applying control unit applying to the coil a second voltage, higher than the first voltage, upon determining by the determining unit that the current in the coil reaches the second lower limit, wherein the constant-current control unit is configured to execute, after the high-voltage applying control unit applies the second voltage to the coil, the constant current control by allowing or interrupting the first voltage repeatedly such that a voltage applied to the coil takes the values of 0 and the first voltage alternately.

2. An injection control unit comprising:

a constant-current control unit executing a constant current control, which controls a current in a coil, which drives an injector, to be in a predetermined current range lower than a peak current in the coil, by repeatedly allowing or interrupting a first voltage applied to the coil after the peak current causes the injector to start to open;

a determining unit configured to determine whether a predetermined time interval has elapsed from when the current in the coil becomes lower than the predetermined current range after the first voltage is applied to the coil by the constant-current control unit; and a high-voltage applying control unit applying to the coil a second voltage, higher than the first voltage, upon determining by the determining unit that the predetermined time interval has elapsed, wherein the constant-current control unit is configured to execute, after the high-voltage applying control unit applies the second voltage to the coil, the constant current control by allowing or interrupting the first voltage repeatedly such that a voltage applied to the coil takes the values of 0 and the first voltage alternately.

3. The injection control unit according to claim 1, wherein when the current in the coil becomes lower than the predetermined current range, prior to the constant-current control unit executing the constant current control to control the current in the coil to be in the predetermined current range, the high-voltage applying control unit applies the second voltage to the coil for a predetermined time interval.

4. The injection control unit according to claim 1, wherein when the current in the coil becomes lower than the predetermined current range, prior to the constant-current control unit executing the constant current control to control the current in the coil to be in the predetermined current range, the high-voltage applying control unit applies the second voltage to the coil for a predetermined number of times or less.

5. The injection control unit according to claim 1, wherein the constant-current control unit executes a first constant current control of the constant current control to control the current in the coil to be in a first predetermined current range in a first valve-opening interval of the injector and then executes a second constant current control of the constant current control to control the current in the coil to be in a second predetermined current range lower than the first predetermined current range, and the high-voltage applying control unit applies the second voltage higher than the first voltage to the coil when the current in the coil reaches a second lower limit that is lower than a first lower limit of the first predetermined current range.

6. The injection control unit according to claim 5, wherein the current in the coil becomes lower than the first predetermined current range prior to the constant-current control unit executing the constant current control to control the current in the coil to be in the first predetermined current range, and thereafter, the high-voltage applying control unit applies the second voltage for a predetermined time interval.

7. The injection control unit according to claim 5, wherein the current in the coil becomes lower than the first predetermined current range prior to the constant-current control unit executing the constant current control to control the current in the coil to be in the first predetermined current range, and thereafter the high-voltage applying control unit applies the second voltage to the coil for a predetermined number of times or less.

* * * * *